US006745802B2

(12) United States Patent
Varga

(10) Patent No.: US 6,745,802 B2
(45) Date of Patent: Jun. 8, 2004

(54) BOTTLE DRAINAGE COUPLER

(76) Inventor: Carole Varga, 91-32 117 St., Richmond Hill, NY (US) 11418

( * ) Notice: Subject to any disclaimer, the term of this patent is extended or adjusted under 35 U.S.C. 154(b) by 0 days.

(21) Appl. No.: 10/193,606

(22) Filed: Jul. 11, 2002

(65) Prior Publication Data

US 2003/0010400 A1 Jan. 16, 2003

Related U.S. Application Data

(60) Provisional application No. 60/305,432, filed on Jul. 16, 2001.

(51) Int. Cl.[7] ..... B65B 1/04; B65B 3/04; B67C 3/00

(52) U.S. Cl. ..... 141/319; 141/86; 141/363; 141/364; 141/365; 141/366; 248/128

(58) Field of Search ..... 141/311 R, 319, 141/369–372, 363–366, 383, 384, 86, 88; 248/102, 103, 105, 128

(56) References Cited

U.S. PATENT DOCUMENTS

| | | | | |
|---|---|---|---|---|
| 2,773,521 | A | 12/1956 | Persson | 141/5 |
| 3,156,272 | A | 11/1964 | Indrunas | 141/286 |
| 3,261,380 | A | 7/1966 | Holleman | 141/106 |
| 3,261,381 | A | 7/1966 | Roach | 141/114 |
| 3,266,583 | A | 8/1966 | McHale | 141/364 |
| 3,620,267 | A | 11/1971 | Seablom | 141/364 |
| 3,963,063 | A | 6/1976 | Pascarella | 141/309 |
| 4,105,142 | A | 8/1978 | Morris, Jr. | 222/158 |
| 4,217,941 | A | 8/1980 | Catalano | 141/372 |
| 4,625,780 | A | 12/1986 | Burnham | 141/319 |
| 5,285,824 | A | 2/1994 | Krstovic | 141/1 |
| 5,490,545 | A | 2/1996 | Sokoloff et al. | 141/319 |
| 5,642,763 | A | 7/1997 | Kurtz | 141/375 |
| 5,740,654 | A | 4/1998 | Manni et al. | 53/242 |
| 5,884,678 | A | 3/1999 | Chudy | 141/319 |
| 5,964,260 | A | 10/1999 | Chudy | 141/319 |
| 6,085,806 | A | 7/2000 | David et al. | 141/98 |
| D431,971 | S | 10/2000 | Hatton | D7/619 |

*Primary Examiner*—Timothy L. Maust
(74) *Attorney, Agent, or Firm*—Seth Natter; Natter & Natter

(57) ABSTRACT

A bottle drainage coupler unit has upper and lower coupler pairs to support bottles with viscous fluid such as ketchup for stable, effective, mouth to mouth drainage. The drainage is effected without the need for supervision.

12 Claims, 3 Drawing Sheets

BOTTLE DRAINAGE COUPLER

RELATED APPLICATION

This application claims the benefit of of Provisional Application No. 60/305,432, filed Jul. 16, 2001.

BACKGROUND OF THE INVENTION

This invention relates to a stable bottle drainage coupler particularly for the bottle to bottle consolidation of viscous fluids such as ketchup.

Particularly in the restaurants, it is uneconomic to discard ketchup bottles with an unused residue and impracticable to leave almost empty bottles at the table because it is slow and it is inconvenient to use the residue bottle.

The solution to the problem of what to do about the residual ketchup particularly in restaurants has led to the adoption of various coupling devices or support stands for mouth to mouth related consolidation of residual ketchup. There are many systems and devices for consolidating viscous fluids.

A further concern in the consolidation of viscous fluids particularly ketchup is to be able to consolidate as quickly as possible, inexpensively, with stability and without the need to oversee the process.

DESCRIPTION OF THE PRIOR ART

U.S. Pat. No. 6,085,806 discloses an oil drain kit for collecting used motor oil comprising an oil drain collection pan, having a bottom wall raised at the center and sloping to its marginal extremity where it is joined with a side wall having a radial flange at the top of the wall and which extends circumferentially thereabout with a downwardly extending edge portion. The bottom wall is provided at its extremity adjacent its junction with the side wall with at least three discharge openings, each with a funnel spout extending downwardly therefrom. The spouts are adapted to receive the necks of empty oil containers which connect therewith and serve as supporting legs for the drain collection pan.

U.S. Pat. No. 5,964,260 discloses a connector device designed to connect two tubes or containers so as to allow the transfer of fluids from one tube or container to the other. The connector device includes a tubular member made from an elastic material, with the tubular member having an inner wall that includes longitudinal slits. The tubular member can be made from one individual tube or a pair of joined flanged tubes. The flanged tubular members are joined at the flange positions and held together by a collar member.

U.S. Pat. No. 5,884,678 discloses a connector device designed to connect two tubes or containers so as to allow the transfer of fluids from one tube or container to the other. The connector device includes a tubular member made from an elastic material, with the tubular member having an inner wall that includes longitudinal slits. The tubular member can be made from one individual tube or a pair of joined flanged tubes. The flanged tubular members are joined at the flange positions and held together by a collar member. Furthermore, a plurality of individual tubular members can be placed in a rectangular frame member so that the tubular members are perpendicular and integral to the frame member.

U.S. Pat. No. 5,740,654 discloses a packaging assembly intended for the extemporaneous preparation of suspensions or solutions of a solid active product in a liquid product, the active product having been freeze dried and being contained in a flask A and the liquid product being contained in a flask B closed by a dropper, a connection member enabling to put in communication the two flasks for the purpose, in a first step, to cause the liquid product to pass from flask B into flask A containing the solid product, then in a second step, to reverse the assembly and aspirate into flask B, the suspension or solution thus formed.

U.S. Pat. No. 5,642,763 discloses a liquid draining device including a body having a central passageway extending therethrough, an interior funnel formed at the top end of the central passageway near the top end of the body and an interior drip guide formed at the bottom end of the central passageway near the bottom end of the body. The funnel is for receiving any remaining liquid from a first narrow neck container disposed in an inverted relation thereover. The drip guide is for discharging any liquid draining down from the funnel through the central passageway into a second narrow neck container disposed in an upright relation thereunder.

U.S. Pat. No. 5,490,545 discloses a vortex connector system with a connector body with a projection therein to selectively abut one of a plurality of removable inserts. The removable inserts have holes with different sizes, shapes, patterns, depths and numbers, in order to allow observation of how such variations affect the vortex effect and/or flow rate of fluid between plastic bottles connected by the connector body.

U.S. Pat. No. 5,285,824 discloses an oil drainage catch pan having an open top for receiving used engine oil drained therein, has a reservoir on one end of the pan with a discharge spout and a container connected by a coupling to the spout. After collecting the used oil in the catch pan, the catch pan is tilted, causing the used oil to flow to the reservoir and drain through the spout into the container for containment and transport to a suitable location.

U.S. Pat. No. 4,625,780 discloses a vortex connector for threaded plastic bottles, provided in which the connector has a pair of opposed recesses, each connecting with an inner female helically threaded recess, the recesses connecting to one another through an axially elongated constriction venturi. One of the bottles is partially filled with water. The so-coupled bottles are pivoted so that the water containing bottle is on top, the upper bottle is given a circular swirl or two and the water flows in a clearly discernible whirlpool or vortex from the upper bottle to the lower while the displaced air flows from the lower bottle to the upper through the thus formed vortex in an educational or entertaining display.

U.S. Pat. No. 4,217,941 discloses a ketchup rapping apparatus having a pair of L-form racks hinged to one another, each adapted to hold a ketchup bottle in a stationary seated position, one of the racks being pivotable through 180 degrees from a back-to-back relationship with the other rack to carry its bottle to inverted vertical alignment with the other bottle, a resilient guide cup to be disposed between the mouth ends of the aligned bottles for avoiding glass to glass bottle contact and for guiding the bottle being inverted down into the aligned position with the other bottle, a latch for securing the pivoted rack in the inverted condition, and shock absorbing pads on the bottom of the non-inverted rack enabling rapping of the latter in the inverted condition of the apparatus against a solid surface so as to jar free a clogged ketchup flow condition without damaging the apparatus or the bottles.

U.S. Pat. No. 4,105,142 discloses a device for dispensing fluid substances which includes a dispensing container for holding a metered amount of the fluid substance therein immediately prior to dispensing and which includes a primary opening in the top edge thereof which is adapted to be capped during filling of the dispensing container and which is adapted to be opened when it is desired that the metered amount of fluid substance should be dispensed from the container, the dispensing container also includes a secondary opening in the lower section thereof which may be substantially smaller than the primary opening, the device further includes a hollow adapter secured to the secondary opening of the dispensing chamber and adapted to be secured to the neck of a bottle or other source of the fluid substance to be dispensed, the hollow adapter including a dispensing collar adapted to be secured to the secondary opening of the dispensing container and a holder collar adapted to be secured to the neck of a bottle or holder of the fluid substance.

U.S. Pat. No. 3,963,063 discloses a viscous liquid transfer device for emptying partially filled bottles of ketchup, mustard, etc. in restaurants, to make a full bottle. The device comprises an upwardly and downwardly flared cylinder having attached to an inner wall surface, a vent tube which extends into the bottle to be emptied while inverted with its neck supported on the upwardly flared portion, while the downwardly flared portion rests on the neck of the bottle to be filled.

U.S. Pat. No. 3,620,267 discloses a device for transferring viscous fluids, such as catsup, from one bottle to another, wherein an expansion chamber is provided between the pouring spouts of the bottles to enhance the downward flow of catsup by relieving the central portions thereof to permit air displaced from the lower bottle to bubble up through the flowing catsup into the upper bottle.

U.S. Pat. No. 3,266,533 discloses a draining assembly including a support base and a coupling member. The drainage assembly has a centrally recessed portion for receiving the bottom portion of a container in seated frictional engagement and a coupling member designed for slip-fit frictional engagement with the threaded outlet portion of the container. A threaded outlet portion of another container is supported in inverted position thereon.

U.S. Pat. No. 3,261,381 discloses a coupling member for tubes.

U.S. Pat. No. 3,261,380 discloses a support stand for supporting and draining ketchup bottles mouth to mouth.

U.S. Pat. No. 3,156,272 discloses an invention which relates generally to bottle coupling devices, and more particularly, to coupling devices for draining ketchup bottles or the like.

U.S. Pat. No. 2,773,521 discloses an invention which relates to an improved coupling for squeeze bottles and has for one of its principal objects the provision of a simple, efficient and easily operated device for refilling a squeeze-type dispenser container of liquids by the customer for reuse.

U.S. Design Pat. No. 431,971 discloses an ornamental design for a water bottle magnetic coupler.

It is respectfully requested that this citation of art consist of record about the within application.

BRIEF SUMMARY OF THE INVENTION

The problem of utilizing the residual viscus fluid in a container has challenged many to save the usable portions of such residual fluids. Saving the residue in ketchup bottles has been enabled particularly because of the established, shape of the many bottles and the desireabilty of being able to use the residue.

At least as early as 1962, devices have shown up in the patent art, directed specifically to the mouth to mouth type coupling of ketchup bottles to consolidate the residue of a partly used ketchup bottle into another partly used one as shown in U.S. Pat. No. 3,156,272.

The present invention is a stable bottle drainage system, particularly for the consolidation of viscous food residue with greater expedience, simplicity, stability and economy.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWINGS

Referring now to the figures in greater detail, where like reference numbers denote like parts in the various figures.

DETAILED DESCRIPTION OF THE DRAWINGS

Figure 1:
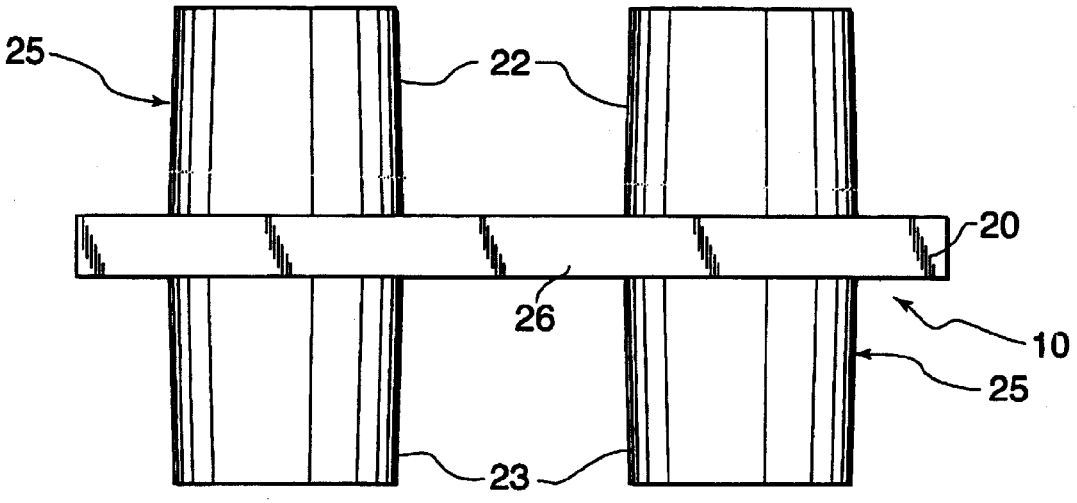
FIG. 1 is a front elevation of the drainage coupler of the present invention.

As shown in FIGS. 1–4 a drainage coupler 10 includes an integral support rim 20, a base 26, a pair of bottle neck receivers 22 and a pair of bottle neck receivers 23.

The generally planar base 26 is provided with openings 21 between each upper bottle neck receiver 22 and its coaxial lower receiver 23. The bottle neck receivers 22 and bottle-neck receivers 23 form individual couplings 25. Each upper bottle neck receiver 22 includes a vertical internal bottle neck stop or support which extends radially inwardly from a cylindrical inner wall and axially upwardly from a rim 33 of the planar base 26 which defines the opening 21. The top of the neck support 27 is shaped in a "V" notch 28. Each lower bottle neck receiver 23 includes a plurality of rib spacers 29. There are parallel horizontal support ridges 24 on the base 26 between the bottle neck receivers 22. There are preferably, also support ridges 24 joining the receivers 23.

Figure 3:
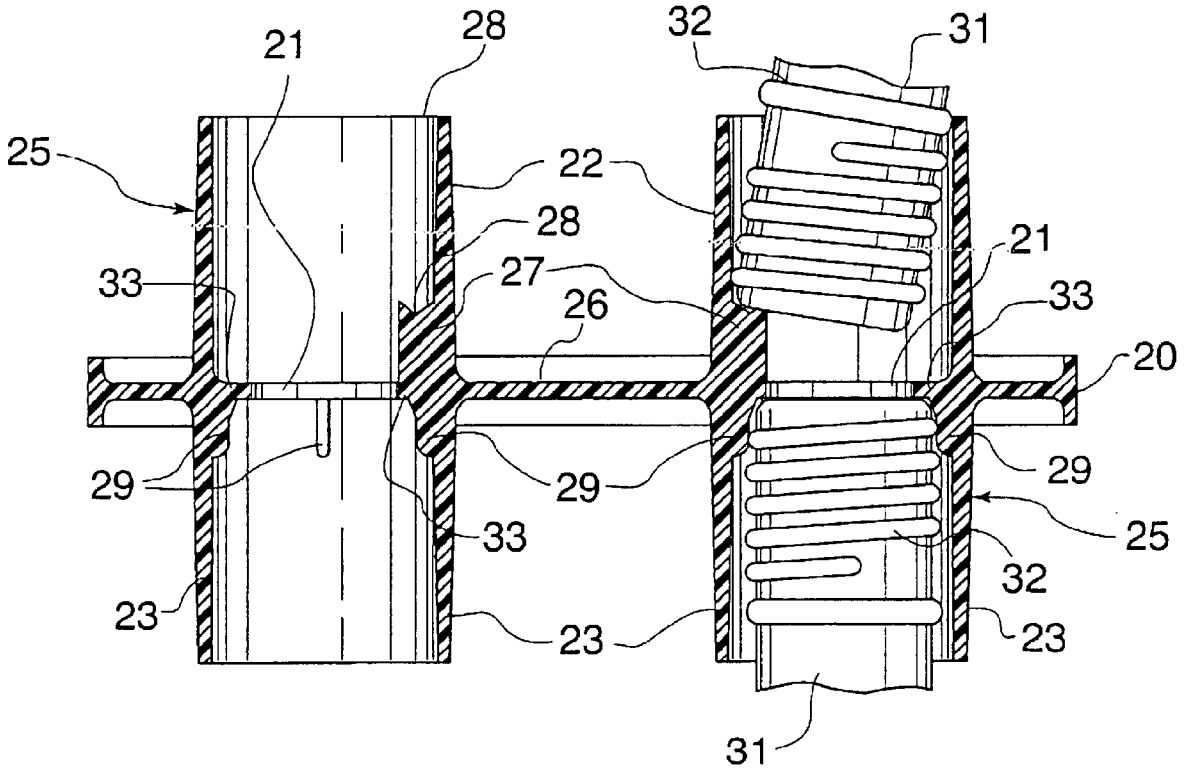
FIG. 3 is a vertical section of FIG. 1 showing a detail of the coupled arrangement of two bottles.
Figure 5:
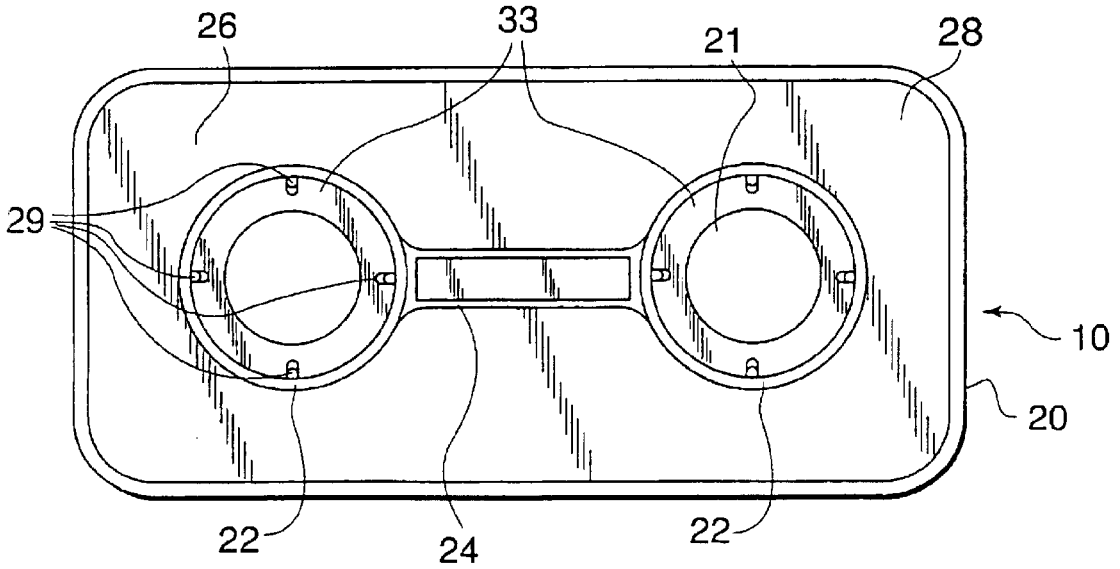
FIG. 5 is a bottom view therof.

FIG. 3 is a vertical section of the coupler 10 showing the engagement of necks 31 of a bottles 30 in a bottle neck receivers 22 and 23.

Figure 4:
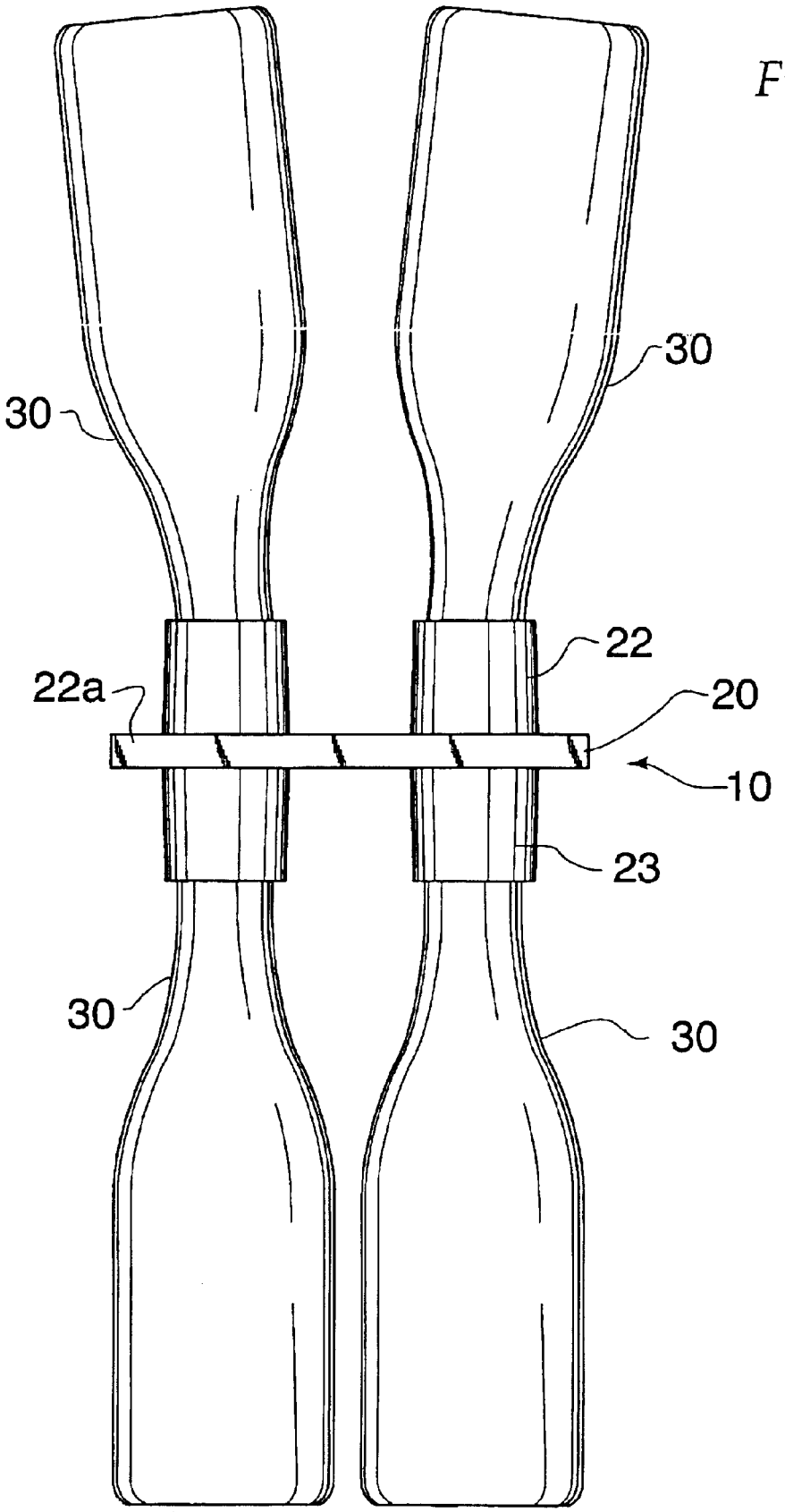
FIG. 4 is a front elevation of drainage coupler of the present invention in use with two sets of bottles.

FIG. 4 shows the coupler 10 in use with bottles 30 engaged in the coupler 10.

As shown in FIGS. 1–4 each coupling 25 comprises an aligned bottle neck receiver 22 and bottle neck receiver 23 over an aperture 21 separated by a base 26. The sets of couplings 25 receive the necks 31 of bottles 30 so that residual fluids such as ketchup can be consolidated in another partially used bottle 30.

The coaxial bottle neck receivers 22 and 23 extend vertically from the base 26 over the apertures 21. Each bottle neck receiver 22 includes a vertical neck support 27. The respective neck supports 27 appose each other along the longitudinal axis of the base. Each neck support 27 includes a "V" notch 28 at its upper end which function as an abutment stop. The bottle neck receivers 23 each include a series of rib spacers 29 on the inside periphery of generally cylindrical inner walls.

As shown in detail in FIG. 3 the necks 31 of two bottles 30 are engaged in a bottle neck receiver 22 and a bottle neck receiver 23 of the coupling 25. FIG. 4 shows the coupler 10, in use with four bottles 30 engaged.

As shown in FIG. 3 the bottle neck receivers 22 and bottle neck receivers 23 extend from the base 26 over the apertures 21 forming two extending couplings 25.

Figure 2:
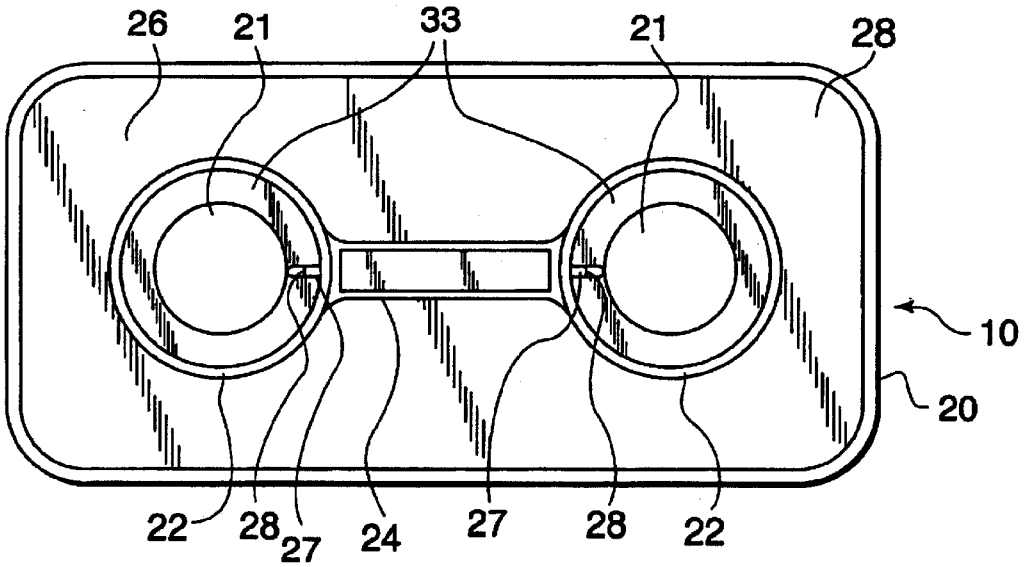
FIG. 2 is a plan view of FIG. 1.

As shown in FIG. 2, the drainage coupler 10 with the bottleneck receivers 22 and apertures 21 form one part of the coupling 25. The bottle neck receivers 22 and 23 each have an inner diameter greater than the aperture 21, thus rims 33 are formed in the couplings 25.

FIG. 3, shows a detail of the necks 31, cut away, of two bottles 30 engaged in a coupling 25. The bottles 30 shown in FIGS. 3 and 4 have a long narrow necks 31 with threads 32. The threads 32 are adapted to receive a bottle cover (not shown). The narrow neck 31 is typical of ketchup bottles for which the present invention is primarily directed.

The end of the neck 31 of one bottle 30 is engaged with the notch 28. Since the diameter of the inner wall of the bottle neck receiver 22 is greater than the diameter of the neck 31, the bottle rests at a slant, supported by the abutment stop notch 28 and leaning upon the top edge of the diametrically spaced portion of the inner wall. The slant is a preferred position for drainage and to avoid the crowding of bottles 30. The neck 31 of another, cut away, bottle 30 is engaged in the bottle neck receiver 23. The neck 31 abuts the aperture 21 and is firmly held by the rib spacers 29. The engagement enables complete drainage of the ketchup from the upper bottle 30 to the lower bottle 30. The system works identically for more than one set of bottles 30 engaged.

The drainage coupler 10 must be supported with a minimum of two bottles 30 in the bottle neck receivers 23. Thus as shown in FIG. 4 two bottles 30 support the coupler 10 and one or two bottles 30 may be drained simultaneously. The coupler 10 can fully function with only one bottle 30 engaged in a bottle neck receiver 22.

The system of the present invention does not require supervision once the minimum bottle combination is in place.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A bottle drainage coupler including a generally planar base, at least two spaced bottle neck coupler sets extending from said base, said base including apertures sets therethough, each said coupler set including a first bottle neck receiver on an upper portion of said base and a second coaxial bottle neck receiver apposed on a lower portion of said base, each said first bottle neck receivers having a generally cylindrical inner wall with a diameter larger than the diameter of the neck of selected bottles to be drained, each said first bottle neck receivers including an abutment stop bottle neck support extending radially inwardly from the inner wall and upwardly from the plane of the base, whereby when the neck of a selected bottle to be drained is placed in said first bottle neck receiver of one coupler set, an end of the neck abuts the bottle neck support and the bottle is supported in a slanted position, resting upon a top edge of the cylindrical inner wall diametrically spaced from the bottle neck support.

2. The invention of claim 1 wherein said planar base forms an inner rim at said apertures.

3. The invention of claim 1 wherein said second bottle neck receiver of the one coupler set is dimensioned to accommodate the neck of a bottle selected to receive the contents of the bottle to be drained.

4. The invention of claim 1 wherein said abutment stop neck support includes a notch, whereby the end of the neck engages the notch.

5. The invention of claim 3 wherein said second bottle neck receiver of the other coupler set is dimensioned to receive the neck of a bottle selected to stabilize the drainage coupler when only a single bottle is to be drained.

6. The invention of claim 1 wherein said second bottle neck receivers include generally cylindrical inner walls and a plurality of ribs for engagement with the necks of selected bottles.

7. The invention of claim 1 wherein the abutment stop bottle neck supports of each first bottle neck receiver are apposed along a common diagonal of the first bottle neck receivers.

8. A bottle drainage system for reclaiming residual contents of a first selected bottle to be drained and collecting said residual contents into a second selected bottle, the first bottle having a bottle neck and the second bottle having a bottle neck, the drainage system including a generally cylindrical coupler configured to support the first bottle in a slanted inverted position which facilitates gravity drainage of the residual contents when the coupler engages the neck of the second bottle in an upright position, the coupler including an upper bottle neck receiver and a coaxial lower bottle neck receiver, the lower bottle neck receiver being dimensioned to engage the neck of the second bottle, the upper bottle neck receiver including a generally cylindrical inner wall, a bottle neck support extending radially inwardly from the inner wall and an abutment stop at the upper end of the bottle neck support, the abutment stop for engagement with an end of the neck of the first bottle, the neck of the first bottle having a diameter less than the diameter of the inner wall whereby, when the neck of the first bottle engages the abutment stop, the first bottle slants to a position wherein it is restrained from tipping over by engagement between the neck of the first bottle and a top edge of the inner wall diametrically spaced from the abutment stop.

9. A bottle drainage system for reclaiming residual contents of a first selected bottle to be drained and collecting said residual contents into a second selected bottle, the first bottle having a bottle neck and the second bottle having a bottle neck, the drainage system including a generally cylindrical first coupler configured to support the first bottle in a slanted inverted position which facilitates gravity drainage of the residual contents when the coupler engages the neck of the second bottle in an upright position, the coupler including an upper bottle neck receiver and a coaxial lower bottle neck receiver, the lower bottle neck receiver being dimensioned to engage the neck of the second bottle, the upper bottle neck receiver including a generally cylindrical inner wall, and an abutment stop for engagement with an end of the neck of the first bottle, the neck of the first bottle having a diameter less than the diameter of the inner wall whereby, when the neck of the first bottle engages the abutment stop, the first bottle slants to a position wherein it is restrained from tipping over by engagement between the neck of the first bottle and a ton edge of the inner wall diametrically spaced from the abutment stop, the bottle drainage system further including a second generally cylindrical coupler, the couplers being laterally spaced from one another, the bottle drainage system further including a generally planar base interconnecting the couplers.

10. A bottle drainage system as constructed in accordance with claim 9 wherein the second coupler includes an upper bottle neck receiver and a coaxial lower bottle neck receiver, the upper bottle neck receiver of the second coupler including a generally cylindrical inner wall and an abutment stop, the abutment stops of each coupler being apposed and lying along a diagonal common to both couplers.

11. A bottle drainage system as constructed in accordance with claim 10 wherein the upper bottle neck receiver of each coupler includes a bottle neck support extending radially inwardly from the inner wall, the abutment stops being positioned at the upper end of each bottle neck support.

12. A bottle drainage system for reclaiming residual contents, the system comprising a first bottle to be drained of residual contents and a second bottle for collecting said residual contents, the first bottle having a bottle neck and the second bottle having a bottle neck, the drainage system including a generally cylindrical coupler, the first bottle being supported by the coupler in a slanted inverted position which facilitates gravity drainage of the residual contents, the coupler engaging the neck of the second bottle, the second bottle being in an upright vertical position, the coupler including an upper bottle neck receiver and a coaxial lower bottle neck receiver, the lower bottle neck receiver engaging the neck of the second bottle, the upper bottle neck receiver including a generally cylindrical inner wall and an abutment stop engaging a portion of an end of the neck of the first bottle, the neck of the first bottle having a diameter less than the diameter of the inner wall, the first bottle being restrained from tipping over by engagement between the neck of the first bottle and a top edge of the inner wall diametrically spaced from the abutment stop.

* * * * *